US006837776B2

(12) United States Patent
Shimobeppu et al.

(10) Patent No.: US 6,837,776 B2
(45) Date of Patent: Jan. 4, 2005

(54) FLAT-OBJECT HOLDER AND METHOD OF USING THE SAME

(75) Inventors: Yuzo Shimobeppu, Kanagawa (JP); Kazou Teshirogi, Kanagawa (JP); Kazuhiro Yoshimoto, Kanagawa (JP); Mitsuhisa Watanabe, Kanagawa (JP); Yoshiaki Shinjo, Kanagawa (JP); Takashi Mori, Tokyo (JP); Koichi Yajima, Tokyo (JP); Yusuke Kimura, Tokyo (JP)

(73) Assignees: Fujitsu Limited, Kanagawa (JP); Disco Corporation, Tokyo (JP)

( * ) Notice: Subject to any disclaimer, the term of this patent is extended or adjusted under 35 U.S.C. 154(b) by 106 days.

(21) Appl. No.: 10/208,104

(22) Filed: Jul. 31, 2002

(65) Prior Publication Data

US 2003/0077993 A1 Apr. 24, 2003

(30) Foreign Application Priority Data

Oct. 18, 2001 (JP) ..... 2001-320575
Nov. 30, 2001 (JP) ..... 2001-366853

(51) Int. Cl.[7] ..... B24B 1/00

(52) U.S. Cl. ..... 451/41; 451/54; 451/287; 451/289

(58) Field of Search ..... 451/41, 54, 57, 451/63, 67, 69, 285, 287, 289, 388

(56) References Cited

U.S. PATENT DOCUMENTS 5,656,552 A * 8/1997 Hudak et al. ..... 438/15
6,153,536 A * 11/2000 Brouillette et al. ..... 438/758
6,257,966 B1 * 7/2001 Ishikawa et al. ..... 451/67
6,406,357 B1 * 6/2002 Kazui et al. ..... 451/41
6,451,671 B1 * 9/2002 Yamada ..... 438/460

* cited by examiner

*Primary Examiner*—Eileen P. Morgan
(74) *Attorney, Agent, or Firm*—Wenderoth, Lind & Ponack L.L.P.

(57) ABSTRACT

A flat-object holder can hold a flat object-and-frame assembly, and the holder has the flat object fixed to the frame with protection tape. The flat-object holder includes at least a flat object supporting area for fixedly holding the flat object via the protection tape by applying a suction force, and a frame fixing area for fastening the frame. The flat-object holder bearing the flat object-and-frame assembly can be fixedly held by a selected chuck table by applying a negative pressure to the flat object supporting area. The flat-object holder can transfer and put the flat object-and-frame assembly in a container. Thus, no matter how thin the flat object may be, it can be handled without the fear of breaking.

10 Claims, 17 Drawing Sheets

FLAT-OBJECT HOLDER AND METHOD OF USING THE SAME

BACKGROUND OF THE INVENTION

1. Field of the Invention

The present invention relates to a flat-object holder for use in holding , semiconductor wafers or other thin, flat objects, and to a method of using such flat-object holders.

2. Related Arts

Referring to FIG. 27, a semiconductor wafer W1 has a plurality of ICs, LSIs or other circuits formed thereon, and it has a protection tape T applied to its front side for protecting the circuits. The semiconductor wafer W1 is put on a chuck table 70 with its protection tape directed down, thereby permitting the rear side of the semiconductor wafer to be ground with a grindstone 71 until a predetermined thickness has been reached. To meet the recent tendency of reducing the size and weight of cellular phones, notebook-sized personal computers and other electronic devices, it is required that parts of such devices be down-sized accorcingly, and semiconductor wafers need to be ground until their thickness is 100 or less $\mu$m thick, or 50 or less $\mu$m thick.

If semiconductor wafers are ground to be 200 to 400 $\mu$m thick, they are thick and strong enough to facilitate their transfer in the grinding apparatus or insertion in containers without fear of their being broken. However, semiconductor wafers whose thickness is reduced to be 50 to 100 $\mu$m cannot be transferred with ease because of their fragility.

Referring to FIG. 28, a semiconductor wafer W2 has grooves 72 made in the form of a lattice on its front side, each groove being deep enough to be equal to the thickness of each of the semiconductor chips, into which the semiconductor wafer W2 is to be diced. The semiconductor wafer W2 is ground on its rear side until the grooves 72 appear on the rear side to divide the semiconductor wafer into squares. This is called a "pre-dicing" method. Such square pieces, however, are too fragile to hold their appearance free of any defects.

In an attempt to avoid such inconvenience, protection tapes of good strength, for instance, made of polyethylene terephthalate are applied to semiconductor wafers. Such reinforced semiconductor wafers or chips can be transferred or put in containers without fear of breaking. Disadvantageously, such protection tapes cannot be peeled off the semiconductor wafers or chips without difficulty.

Referring to FIG. 29, a semiconductor wafer W is fixedly held by an annular frame F with the aid of an adhesive protection tape T to be convenient for dicing. Such wafer-and-frame assemblies are convenient for handling in transport or for putting in containers, and the protection tapes can be removed from the thin wafers or chips with ease. Disadvantageously the grinding machine needs to be modified so that its chuck table may hold the wafer-and-frame assembly.

In view of the above, there has been a demand for handling fragile flat objects such as semiconductor wafers easily when transporting; permitting the chuck table to hold such fragile flat objects without the necessity of redesigning the chuck table; and removing semiconductor wafers from their protection tapes with ease after being grounded.

SUMMARY OF THE INVENTION

In the hope of solving the problems described above, a flat-object holder for holding a flat object-and-frame assembly having a flat object fixed t o its frame with a protection tape according to the present invention comprises at least a flat object supporting area for fixedly holding the flat object via the protection tape by applying a suction force, and a frame fixing area for fastening the frame.

The flat object supporting area may be provided by a porous member. In addition, the frame may have an opening for accommodating the flat object and a tape applying area encircling the opening for having the protection tape applied thereto, the frame fixing area being at a level lower than the flat object supporting area.

The top surface of the frame when being fastened to the frame fixing area may be positioned at a level lower than the upper surface of the flat object supporting area, and the frame fixing area may comprise a frame fastening section and frame releasing means. The frame may also comprise a ring-like body defining an opening for accommodating the flat object, and using its brim or inner circumference as a protection tape support, the frame fixing area being at a level lower than the upper surface of the flat object supporting area. Thus, the protection tape may be fixedly stretched between the outer circumference of the flat object supporting area and the inner circumference of the ring-like frame.

The frame may have tightening-and-loosing means associated Therewith, and the flat-object holder may be constructed so that a plurality of frames each holding a flat-object therein may be laid on each other. In addition, the flat-object holder may have a recess on its bottom to accommodate the flat object of the lower flat-object holder in a non-contact fashion when two or more flat-object holders are laid on each other. The flat-object holder may have a bearing section formed on its top to abut the circumference of the bottom recess of the upper flat-object holder for bearing the upper flat-object holder, and the flat-object holder may have a riding section formed on its bottom to surround the bottom recess and ride on the bearing section of the lower flat-object holder.

The flat object supporting area may have a temperature-controlling means embedded therein, The temperature controlling means may be capable of heating or cooling a selected area of the flat object. The temperature controlling means may also include a pipe for permitting a thermal medium to flow therein, an electric heating wire or a Peltier element.

The flat-object holder may further comprise identification means, and the identification means may include bar codes or IC chips.

A method of using a flat-object holder in a grinding machine comprising a chuck table for holding flat objects by applying negative pressure for suction, and a grinding means for grinding the flat objects fixedly sucked onto the chuck table, may comprise putting flat-object holders as described above on the chuck table; grinding the flat object fixedly held by a selected flat-object holder with the grinding means; removing the flat object from the chuck table after grinding; and transporting the flat object thus removed from the chuck table.

The method may further comprise, subsequent to the grinding of the flat object of the selected flat-object holder, applying a die-attachment film to the flat object; applying a dicing tape to the die-attachment film; and applying a dicing frame onto the outer circumference of the dicing tape.

The method may further comprise, subsequent to the step of applying the dicing frame onto the outer circumference of the dicing tape, the step of removing the dicing frame, the flat-object holder, and the protection tape all together from the flat object. The flat objects may be semiconductor wafer, rearrange, wired semiconductor substrates or rearranged, wired and resin-sealed semiconductor substrates.

Thanks to the holding of a thin, flat object with its frame via an associated protection tape as a whole, such a fragile object can be held in a stable and safe fashion, and can be held by the chuck table without the necessity of redesigning the chuck table in a grinding machine.

Other objects and advantages of the present invention will be understood from the following description of preferred embodiments of the present invention, which are shown in accompanying drawings.

DETAILED DESCRIPTION OF THE PREFERRED EMBODIMENT

Figure 1:
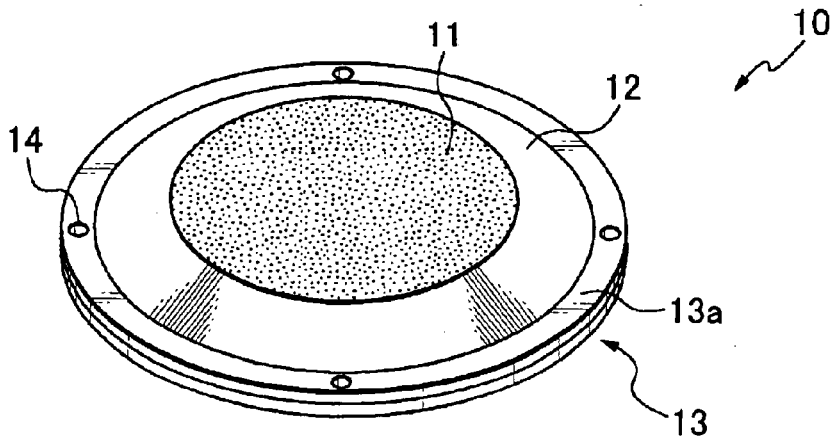
FIG. 1 is a perspective view of a flat-object holder according to a first embodiment of the present invention.

FIG. 1 shows a flat-object holder 10 according to a first embodiment of the present invention. The flat-object holder 10 comprises a flat object supporting area 11 to be formed corresponding to the shape and size of a flat object, an encircling support 12 (made, for example, of alumina ceramics) for supporting the fiat object supporting area 11 at its circumference, and a frame fixing area 13 defined on the outer circumference of the encircling support 12.

The flat object supporting area 11 is formed by a porous member such as porous ceramic, allowing air to pass therethrough to hold the flat object. The flat object supporting area 11 is about 5 mm thick, capable of stably holding thin objects whose thickness is several tens $\mu$m.

Figure 3:
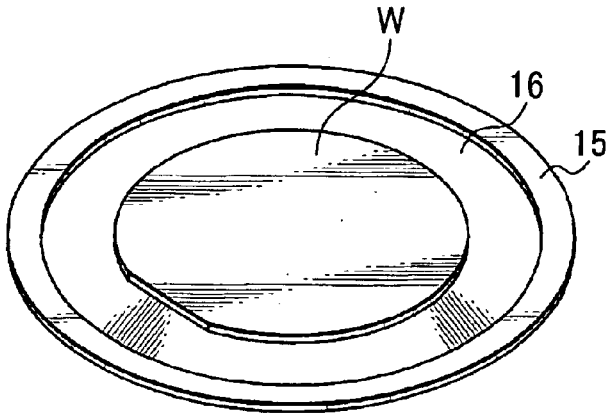
FIG. 3 is a perspective view of a wafer-and-frame assembly having a wafer combined with its frame via a protection tape.

The frame fixing area 13 has a magnet embedded in its fastening section 13*a* for attracting a metal frame 15 (see FIG. 3). The fastening section 13*a* may have a double-sided adhesive tape, glue, or a clip applied thereto to fixedly hold the overlying frame 15. The fastening section 13*a* has through holes 14 made therein, thereby permitting a pin-like tool (not shown) to push in a selected through hole for raising the overlying frame.

Figure 2:
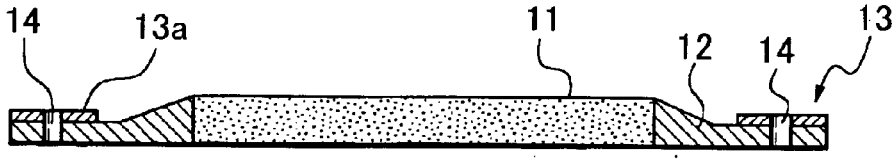
FIG. 2 is a longitudinal section of the flat-object holder.

Referring to FIG. 2, the fiat object supporting area 11 is thicker than the frame fixing area 13, the top surface of which remains at a level lower than the top surface of the flat object supporting area 11.

A flat object such as a semiconductor wafer W is put on an adhesive protection tape 16 as shown in FIG. 3, which is applied to the rear side of the ring-like frame 15. Thus, the semiconductor wafer W is integrally connected to the frame 15 via the protection tape 16.

Figure 4:
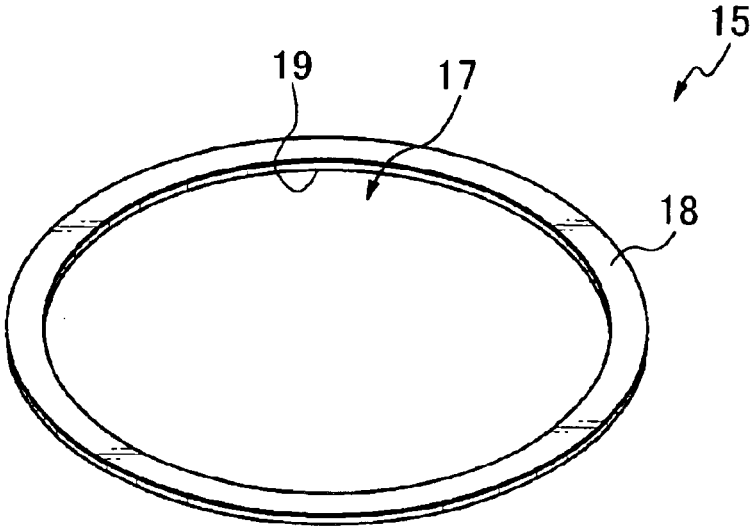
FIG. 4 is a perspective view of a frame.

Referring to FIG. 4, the ring-like frame 15 has an opening 17 for accommodating a flat object and a front side 18, and the rear side 19 of the frame 15 is used as a tape applying area, which encircles the opening 17. As shown in FIG. 3, the protection tape 16 is applied to the rear side (tape applying area) 19 to close the opening 17.

Figure 5:
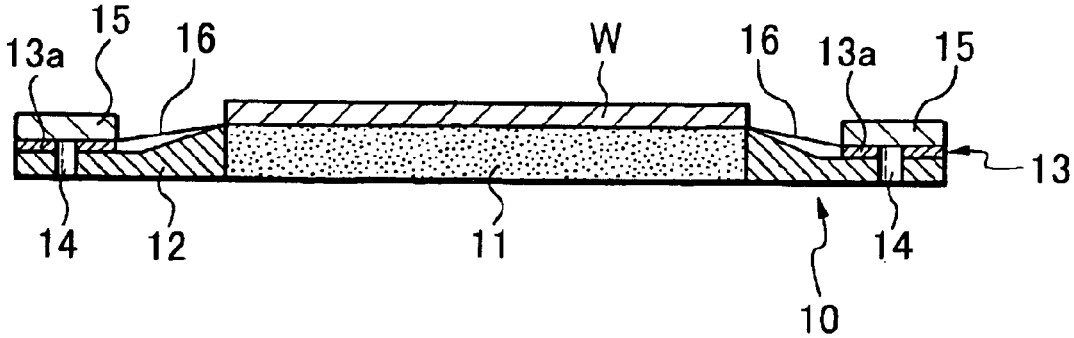
FIG. 5 is a longitudinal section of a flat-object holder, showing how a wafer-and-frame assembly can be supported.

Referring to FIG. 5, the semiconductor wafer-and-frame assembly is laid on the flat-object holder 10 with the protection tape 16 lying between the semiconductor wafer W and the flat object supporting area 11, and with the frame 15 fixedly laid on the frame fixing area 13. The frame 15 is magnetically attracted to the frame fixing area 13. In this position, the rear side of the semiconductor wafer W is at a level higher than the upper surface of the frame 15, or is almost flush therewith.

A plurality of semiconductor wafers W each integrally combined with the flat-object holder 10 via the protection tape 16 are put in a container 21, which is associated with a grinding machine 20.

A transferring mechanism 22 transports wafer-and-frame assemblies one after another from the container 21 to a positioning device 23, Then, a first transport device 24 transfers wafer-and-frame assemblies one after another from the positioning device 23 to a selected chuck table 25.

Figure 7:
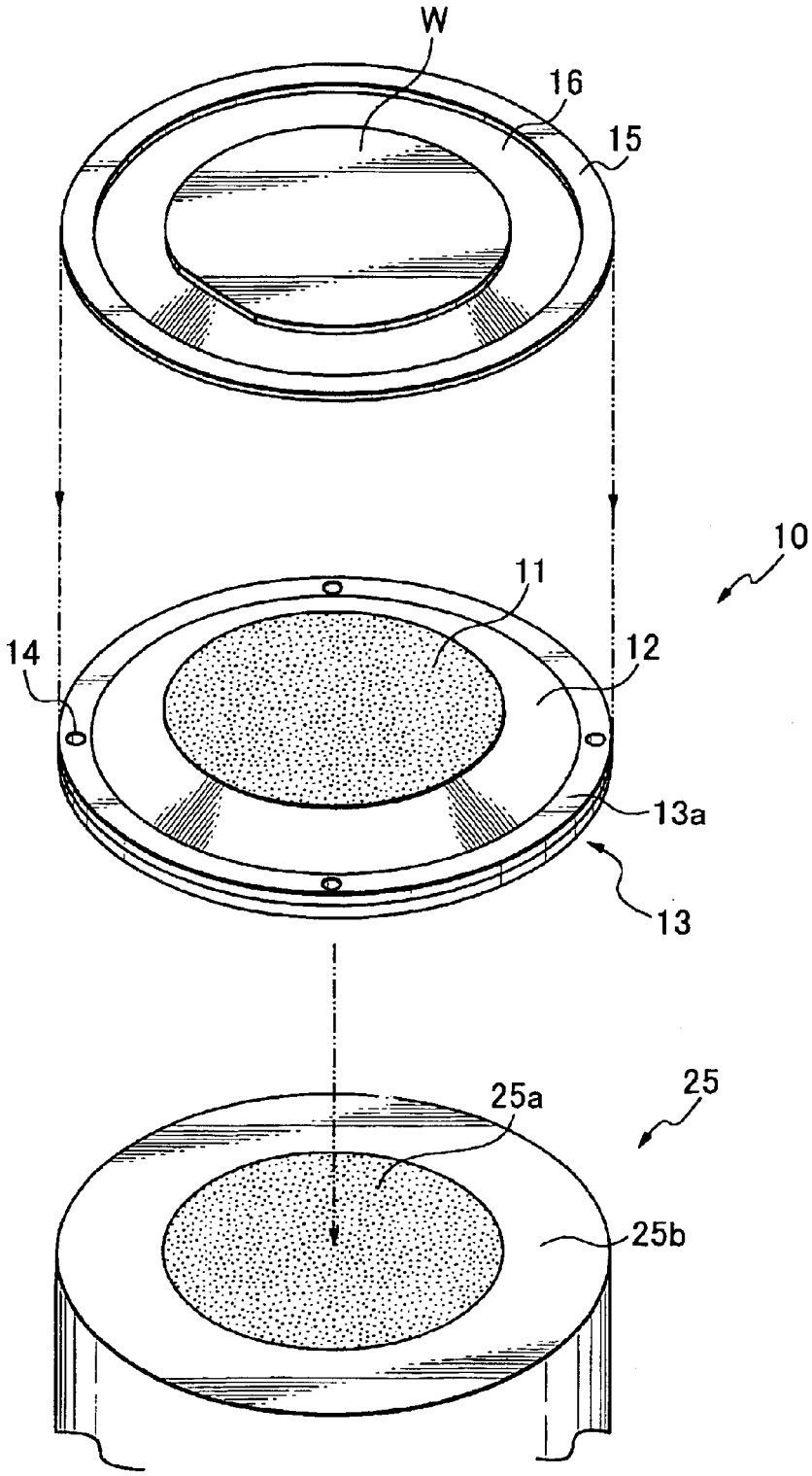
FIG. 7 is a perspective view of the chuck table of the grinding machine, a flat-object holder, and a wafer-and-frame assembly having a wafer combined with its frame via a protection tape.

Referring to FIG. 7, the chuck table 25 comprises a porous suction area 25*a* made of porous ceramic material permitting air to pass therethrough, and an annular frame body 25*b* supporting the suction area 25*a* by the outer circumference of suction area 25*a*. A suction source (not shown) is connected to the lower surface of the suction area 25*a* so that the flat-object holder 10 may be held stably by applying a negative pressure to the suction area 25*a*. Likewise, the protection tape T is sucked and pulled onto the flat object supporting area 11. Therefore, the wafer W is held stably. Each of the other chuck tables 26 and 27 is constructed similarly.

Referring to FIG. 6 again, every chuck table 25, 26 or 27 is rotatable, and can be displaced by a turntable 28. Specifically, every time the turntable 28 is rotated a predetermined angle (120 degrees in this particular example) counterclockwise, two of the three chuck tables can be put under a first and second grinding device 30 and 40.

As shown, the first grinding device 30 is fastened onto a movable support 34, which rides on two parallel rails 32 laid on the upright wall 31 of the grinding machine, and the movable support 34 can be moved vertically along the upright wall 31 by a drive source 33. The first grinding device 30 comprises a rotary spindle 35, a mount 36 fixed to the tip of the rotary spindle 35, a grinding wheel 37 fixed to the mount 36, and a coarse grindstone 38 attached to the grinding wheel 37.

Figure 8:
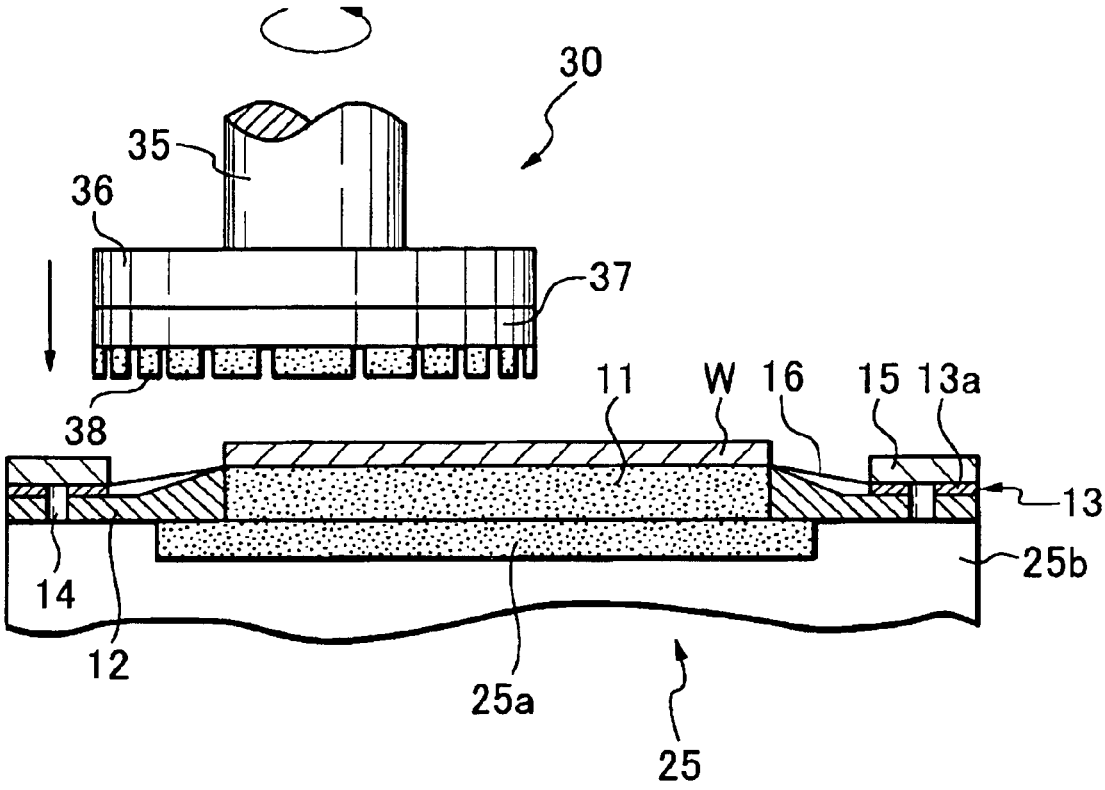
FIG. 8 illustrates, in section, how a wafer is grounded.

Referring to FIG. 8, the rear side of the semiconductor wafer W is coarse-ground by rotating and lowering the rotary spindle 35 of the first grinding device 30. The frame fixing area 13 is at a level lower than the fiat-object holder 11 so that the grindstone 38 cannot abut the frame 15.

When the turntable 28 rotates 120 degrees counterclockwise, the coarse-ground wafer W is put under the second grinding device 40.

The second grinding device 40 is fastened onto a movable support 43, which rides on two parallel rails 41 laid on the upright wall 31, and the movable support 43 can be moved up and down on the upright wall 31. The second grinding device 40 comprises a rotary spindle 44, a mount 45 fixed to the tip of the rotary spindle 44, a grinding wheel 46 fixed to the mount 45, and a fine grindstone 47 attached to the grinding wheel 46.

The rear side of the semiconductor wafer W just below the second grinding device 40 is fine-ground by rotating and lowering the rotary spindle 44 of the second grinding device 40 to keep contact with the rear side of the semiconductor wafer W.

After fine-grinding, the semiconductor wafer W is transferred to a washing station 49, where debris is removed from the fine-ground semiconductor wafer W, and the clean semiconductor wafer W is put in a container 50 with the aid of the transferring mechanism 22.

The wafer-and-frame assembly can be easily removed from the flat-object holder 10 by inserting a pin-like tool in a selected through-hole 14 and by thrusting the wafer-and-frame assembly upward. The protection tape 16 is flexible enough to be peeled off the very thin wafer W without difficulty at the final stage.

The semiconductor wafer W can be held stably by the flat-object holder 10 all the time while being displaced and ground in the grinding machine and when being transferred from the turn table to the container 50, even though the semiconductor wafer W is ground to be 100 or less $\mu$m thick, or 50 or less $\mu$m thick.

The supporting of the wafer-and-frame assembly by the flat-object holder 10 makes it unnecessary to redesign or modify the chuck tables 25, 26 and 27, which otherwise, would have to be redesigned or modified to hold the wafer-and-frame by its frame 15.

Figure 9:
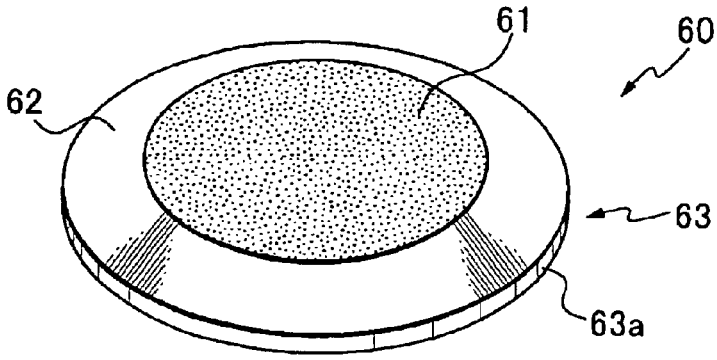
FIG. 9 is a perspective view of a flat-object holder according to a second embodiment of the present invention.

Referring to FIG. 9, a flat-object holder 60 according to a second embodiment comprises a flat object supporting area 61 and an encircling support 62, the outer peripheral side of which defines an outer tape-pinching surface 63*a*. The flat object supporting area 61 is made of a porous ceramic material, and is about 5 mm thick to support a several tens micron-thick object.

The support 62 encircles the flat object supporting area 61, and its major surface is inclined downward from the circumference of the flat object supporting area 61 to the frame foxing area 63, which has the outer tape-pinching surface 63*a*. Thus, the frame fixing area 63 is at a level lower than the upper surface of the flat object supporting area 61.

Figure 10:
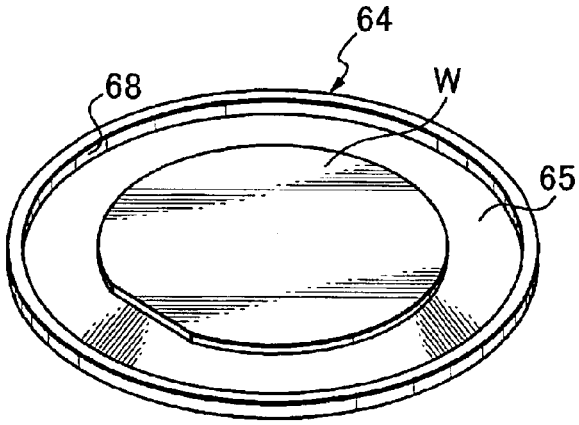
FIG. 10 is a perspective view of a wafer-and-frame assembly having a wafer combined with its frame via a protection tape.

Referring to FIG. 10, a semiconductor wafer W to be supported by the flat-object holder 60 is combined with a ring-like frame 64 via an associated adhesive protection tape 65, which is applied to the rear side of the ring 64.

Figure 11:
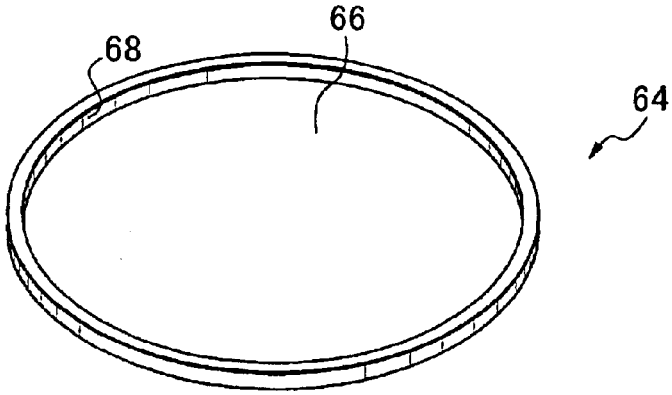
FIG. 11 is a perspective view of the ring-like frame.

Referring to FIG. 11, the ring-like frame 64 has an opening 66 large enough to accommodate snugly accommodate the semiconductor wafer W. The inner circumference of the ring 64 is referred to as "inner supporting surface" 68, and is somewhat larger than the outer tape-pinching surface 63*a* in diameter.

Figure 12:
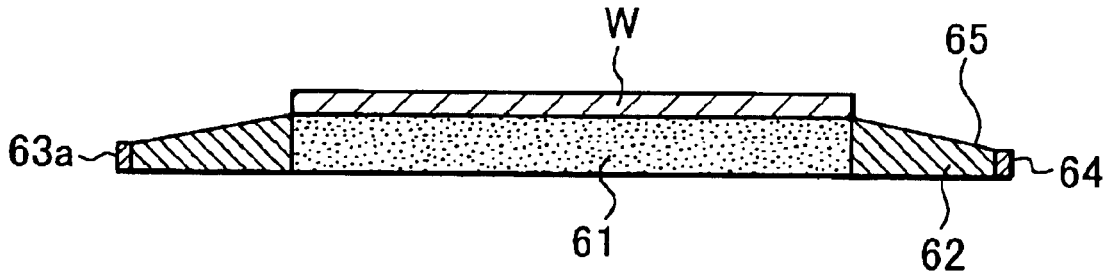
FIG. 12 is a longitudinal section of a flat-object holder, showing how a wafer-and-frame assembly can be supported.

Referring to FIG. 12, the flat-object holder 60 is fitted in the ring-like frame 64 with the outer tape-pinching surface 63*a* facing the inner supporting surface 68, and the semiconductor wafer W is put on the flat object supporting area 61.

Figure 6:
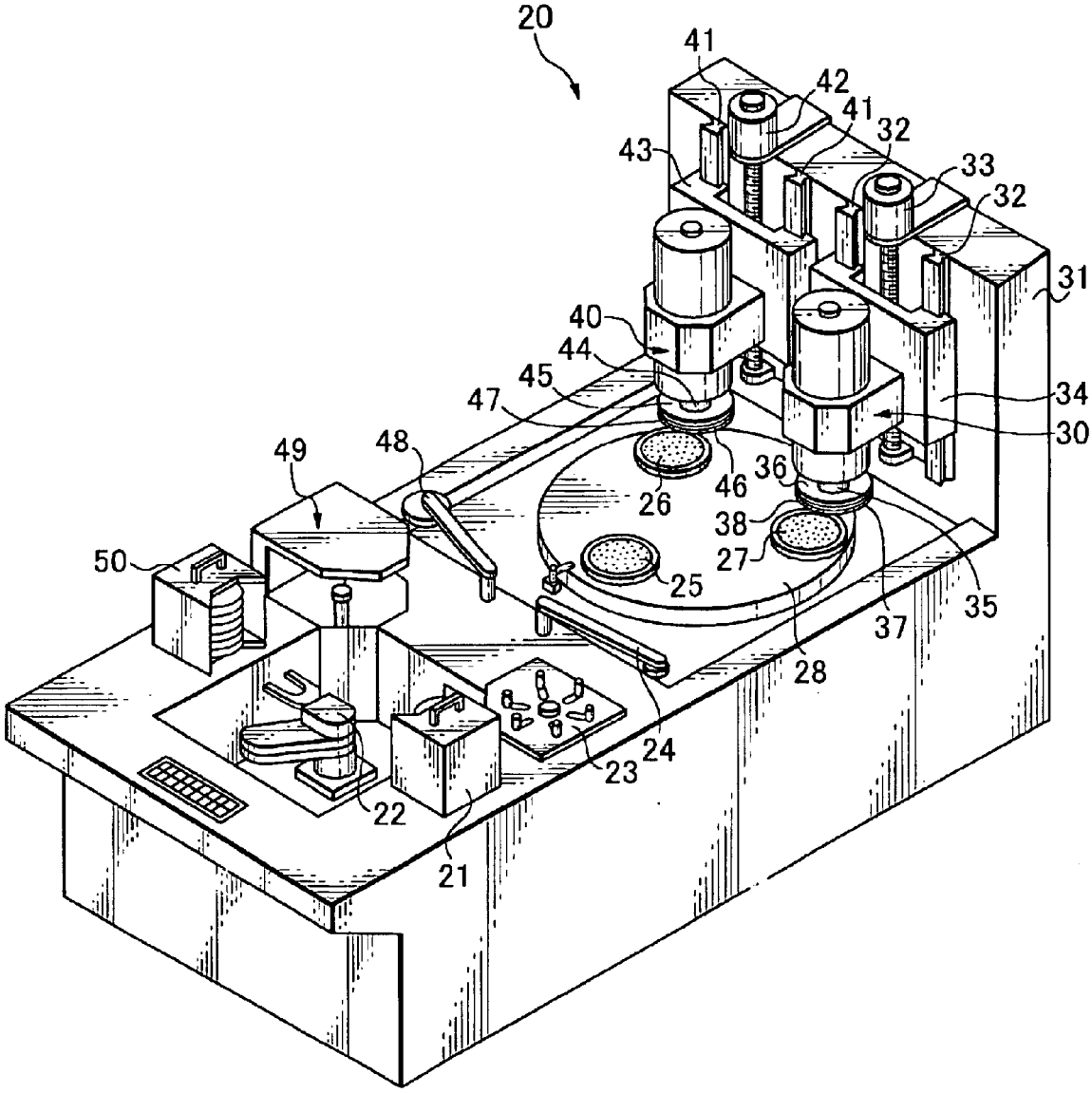
FIG. 6 is a perspective view of a grinding machine.
Figure 13:
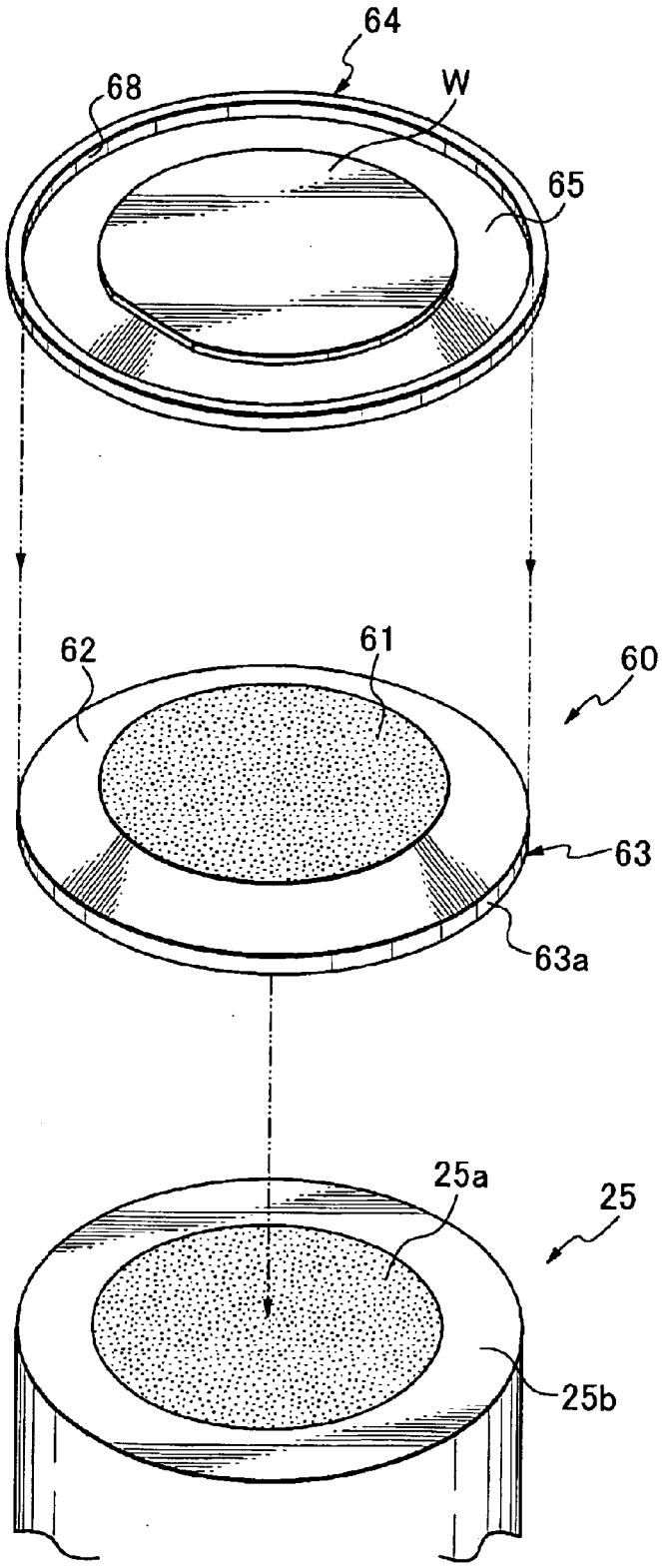
FIG. 13 is a perspective view of the chuck table of the grinding machine, the flat-object holder, and the wafer-and-frame assembly.

Referring to FIG. 13, the fiat-object holder 60 bearing the wafer-and-frame assembly is put on the chuck table 25 so that the semiconductor wafer W may be fixedly held by applying a negative pressure to the suction area 25*a* of the chuck table 25. Thus, the semiconductor wafer W is fixedly held by the chuck table 25 while being ground in the grinding machine as shown in FIG. 6, and the wafer-and-frame assembly can be put in the container 50 easily even though the semiconductor wafer W is ground to be very thin.

When put in the container 50, each wafer-and-frame assembly can be removed from the flat-object holder easily because no suction force is applied. The protection tape 65 is flexible enough to allow the semiconductor wafer W of reduced thickness to be removed from the protection tape T without difficulty.

Thanks to the supporting of the tape-and-frame combination by the flat-object holder 60, the chuck table 25, 26 or 27 need not be redesigned or modified to support the frame 64.

In this particular embodiment, the flat object supporting area and the encircling support are constructed so as to be separate. However, these can be constructed as a whole with a porous body and coated with fluorine or titanium oxide at the area corresponding to the encircling support.

The semiconductor wafer is one example of flat object. Other examples include a rearranged, rewired semiconductor substrate like a flip chip and a rearranged, rewired and resin-sealed semiconductor substrate like a CSP substrate.

One example of using a flat-object holder 60 when grinding the rear side of a semiconductor wafer W to dice the ground semiconductor wafer is described below, beginning with the application of a dicing tape to the semiconductor wafer and ending with removal of the flat-object holder 60.

As is well known, the semiconductor wafer W is ground on its rear side to be divided into squares, and each semiconductor chip is wire-bonded at a later stage. A die-attachment film, however, needs to be applied to the rear side of the semiconductor wafer prior to the wire-bonding.

Figure 14A:
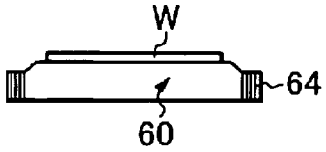
FIGS. 14(A) to 14(K) illustrate one example of applying a dicing tape to the semiconductor wafer, which is laid on a flat-object holder, and of removing the flat-object holder from the semiconductor wafer.
Figure 14B:
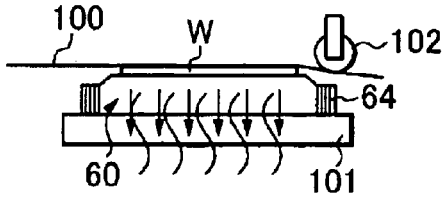

As seen from FIG. 14(B) a die-attachment film 100 is applied to the rear side of the post-grinding semiconductor wafer W, which is fixedly held by the flat-object holder 60 with the frame 64 of the wafer-and-frame assembly tightly fitted on the outer circumference of the fiat-object holder 60 (see FIG. 14(A)).

Specifically the flat-object holder 60 bearing the semiconductor wafer W is put on the table 101 of a mount device to heat the semiconductor wafer to a temperature ranging from 100° to 150°, and then the die-attachment film 100 is applied to the rear side of the semiconductor wafer W by pushing it against the semiconductor wafer W with a roll 102 while the semiconductor wafer W is being fixedly supported by the fat-object holder 60 by applying a negative pressure to the table 101.

Figure 14C:
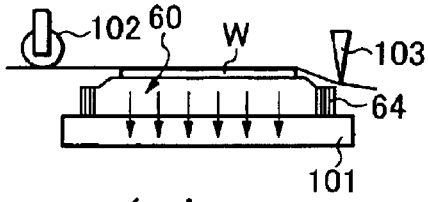
Figure 14D:
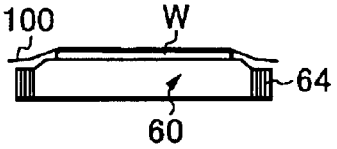

As seen from FIG. 14(C), the die-attachment film 100 is cut around or on the circumference of the frame 64 (see FIG. 14(D)). The heating of the cutter 103 to a temperature ranging from 40° to 60° facilitates the required cutting.

The die-attachment film 100 is applied to not only the semiconductor wafer W but also the frame 64, which can be easily separated from the die-attachment film 100 by lowering the temperature of the die-attachment film 100 when removing the frame 64 as described later.

Figure 14E:
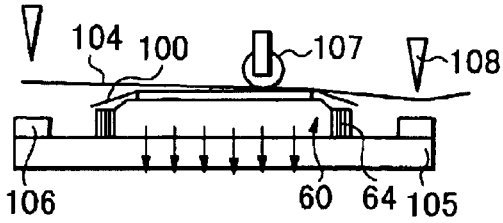

Referring to FIG. 14(E), the flat-object holder 60 is put on the table 105 of a tape-applying device to apply a dicing tape 104 onto the die-attachment film 100. The semiconductor wafer W is fixedly held on the table 105 via the flat object supporting area 61 by applying a negative pressure to the rear side of the table 105. The dicing tape 104 is applied to the underlying die-attachment film 100 with a roll 107, and then, the cutter 108 is used to cut the dicing tape 104 on the dicing frame 106.

Figure 14F:
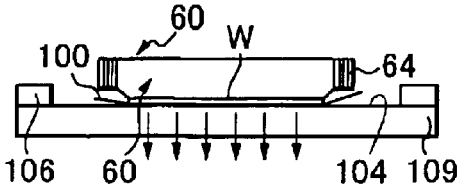

Referring to FIG. 14(F), the semiconductor wafer W having the underlying die-attachment film 100 and the overlying dicing tape 104 applied to its front side, and the flat-object holder 60 having the frame 64 fitted on its outer circumference, are combined as a whole to be turned upside down. The combination is laid on the table 109 of a removal device with the semiconductor wafer W facing downward. The semiconductor wafer is fixedly held on the table 109 via the dicing tape 104 by applying a negative pressure to the rear side of the table 109. The table is preferably made of a porous material to permit suction of the whole area of the semiconductor wafer.

Figure 14G:
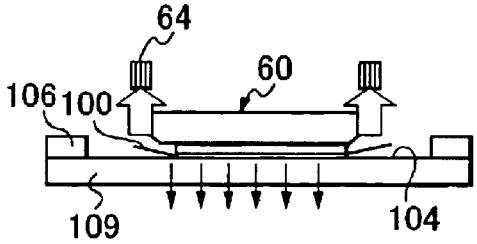

Referring to FIG. 14(G), the frame 64 is raised and removed with the aid of a robot hand or of a magnet when the frame is made of a metal to be magnetically attracted. The frame 64 has the die-attachment film 100 applied thereto. The die-attachment film 100 is lowered to a normal temperature, permitting easy removal of the frame 64 from the die-attachment film 100.

Figure 14H:
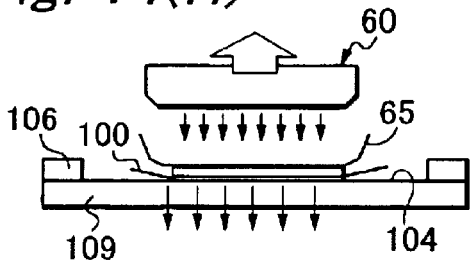

Referring to FIG. 14(H), when the frame 64 is raised and removed from the flat-object holder 60, a small amount of air is made to blow downward from the fiat-object holder 60 to facilitate removal of the flat-object holder 60 from the semiconductor wafer W.

Figure 14I:
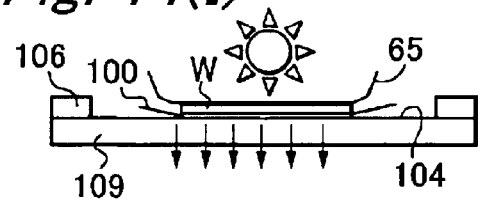

The protection tape 65 is removed subsequent to removal of the flat-object holder 60. If the protection tape is responsive to ultraviolet rays for hardening, the protection tape 65 is exposed to ultraviolet rays beforehand, thereby lowering the adhesive power of the protection tape 65 to facilitate the peeling-off of the protection tape 65, as seen in FIG. 14(I).

Figure 14J:
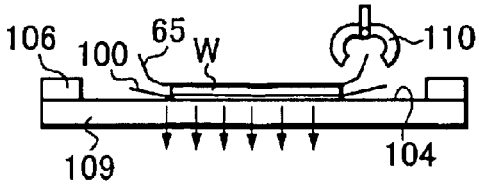
Figure 14K:
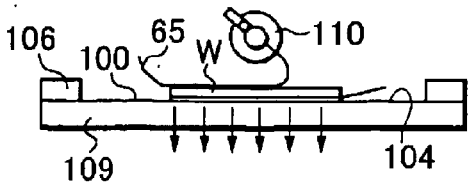

The protection tape 65 is applied to the whole area of the flat-object holler 60, and therefore, it extends beyond the outer circumference of the semiconductor wafer W. The marginal extension of protection tape 65 beyond the outer circumference of the semiconductor wafer is caught b the robot hand 110 to peel off the semiconductor wafer, which is fixedly held on the table 109 via the dicing tape 104, as seen in FIGS. 14(J) and 14(K).

Hitherto, the protection tape 65 has been as large as the semiconductor wafer W and, therefore, an extra tape has been used only for the purpose of peeling the protection tape 65 off the semiconductor wafer. In contrast, the protection tape 65 has a marginal circumference to be caught (grabbed), thereby facilitating the peeling of the protection tape 65 off the semiconductor wafer.

Thus, the semiconductor wafer is integrally combined with the dicing frame 106 via the dicing tape 104, so that the semiconductor wafer may be diced immediately.

If the dicing work follows the grinding of a semiconductor wafer on its rear side (the wafer being fixedly held by a flat-object holder 60), described below is the second example of a process beginning with application of a die-attachment film 100 to the semiconductor wafer and ending with removal of the protection tape 65.

The steps shown in FIGS. 15(A) to 15(F) correspond to those in FIGS. 14(A) to 14(F), although the frame 111 encircling the-fat-object holder 60 is made of a metal, and is expandable.

Figure 16:
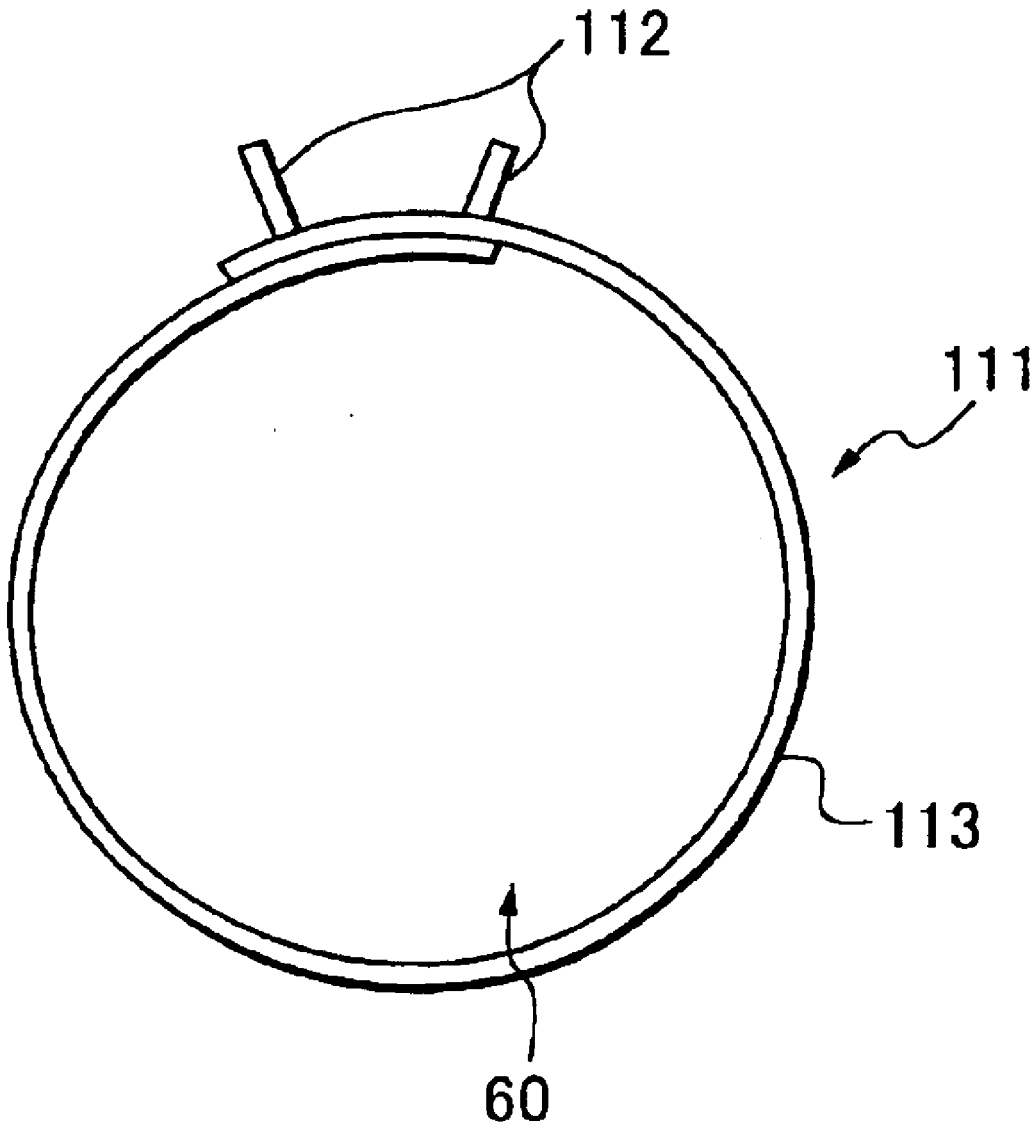
FIG. 16 is a plane view of a tightening-and-loosening frame.

Referring to FIG. 16, the expandable frame 111 is composed of a ring-like steel spring 113 having thumb catches 112 formed at its loop-ends. The expandable frame 111 increases its size as the opposite thumb catches 112 get close to each other whereas the expandable frame 111 decreases its size as the opposite thumb catches 112 separate from each other. The position in which the steel spring ring 113 tightly encircles the fiat-object holder 60 is called the "pinching condition," whereas the position in which the steel spring ring 113 loosely encircles the flat-object holder 60, leaving a small gap therebetween, is called the "releasing condition".

Figure 15A:
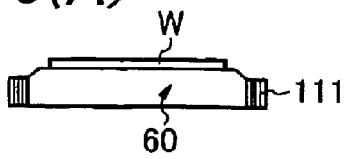
FIGS. 15(A) to 15(L) illustrate another example of applying the dicing tape to the semiconductor wafer, which is laid on the flat-object holder, and of removing the flat-object holder from the semiconductor wafer.
Figure 15B:
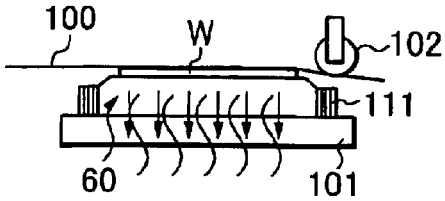
Figure 15C:
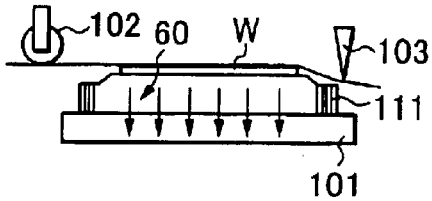
Figure 15D:
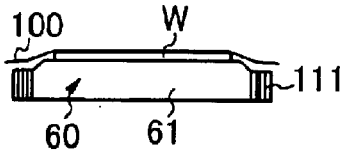
Figure 15E:
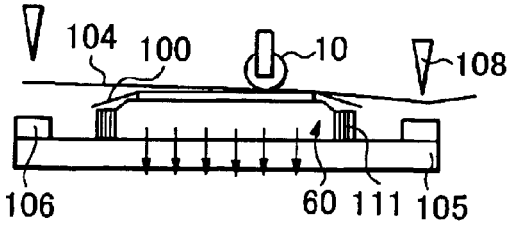
Figure 15F:
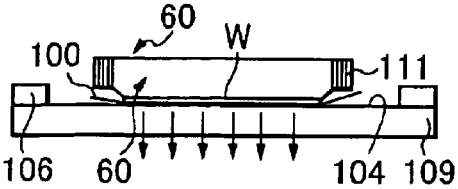
Figure 15G:
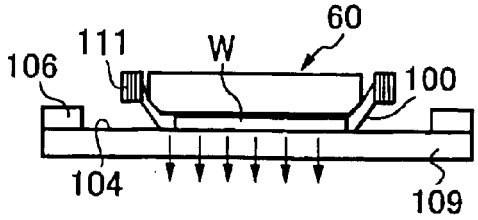

Referring to FIG. 15(G), after the flat-object holder 60 is turned upside down, the expandable frame 111 is put in the releasing condition, still allowing the ring 111 to remain around the flat-object holder 60.

Figure 15H:
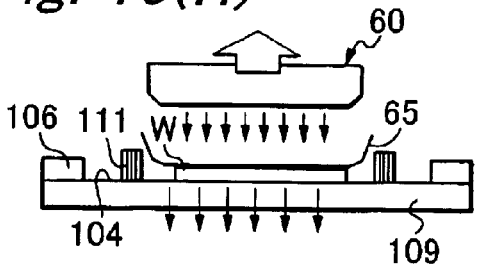

Referring to FIG. 15(H), the flat-object holder 60 is raised with a robot hand while a small amount of air is blown from the flat-object holder 60 to facilitate removal of the semiconductor wafer W from the fiat-object holder 60.

Figure 15I:
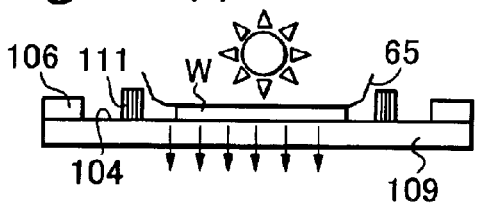
Figure 15J:
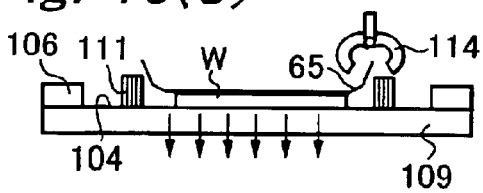
Figure 15K:
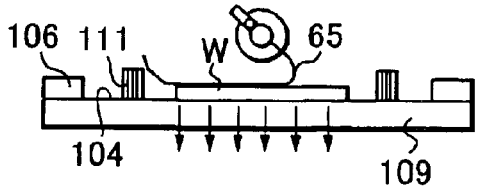

Referring to FIG. 15(I), the ultraviolet sensitive protection tape 65 is exposed to ultraviolet rays for hardening and lowering its adhesive power. Then, the marginal area of the protection tape 65 is caught (grabbed) by the robot hand 114 to peel the protection tape 65 off the semiconductor wafer W, which is fixedly held on the table 109 with the dicing tape 104 laid therebetween.

Here it should be noted that the semiconductor wafer W is fixedly held on the table 109 by allowing the frame 111 to push the semiconductor wafer W against the table 109 via the die-attachment film 100 and the dicing tape 104, which film and tape have the effect of preventing the semiconductor wafer W from being rolled up forcedly to be broken when the protection tape 65 is peeled off the semiconductor wafer W.

Figure 15L:
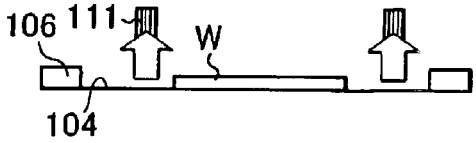

Referring to FIG. 15(L), finally, the expanded frame 111 is removed, leaving the semiconductor wafer W integrally combined with the dicing frame 109, and the combined semiconductor wafer W can be transferred to the dicing station.

Figure 17:
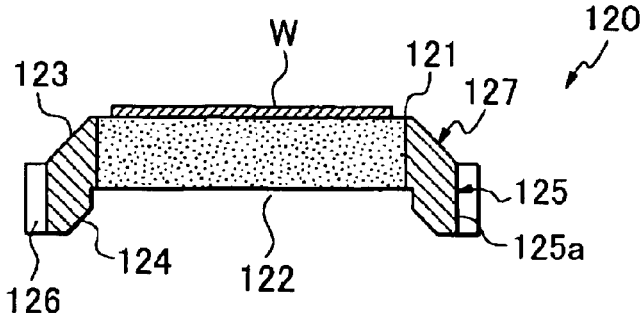
FIG. 17 illustrates, in section, a flat-object holder capable of being stacked.

Referring to FIG. 17, a flat-object holder 120 is designed to be laid on others in the form of a stack. It comprises a fiat object supporting area 121 and a support 127 encircling the flat object supporting area 121. The support 127 has a tape pinching area 125*a* on its outer circumference 125 to cooperate with the inner tape-pinching circumference area of the frame 126 for pinching the outer marginal circumference of the protection tape therebetween.

Figure 18:
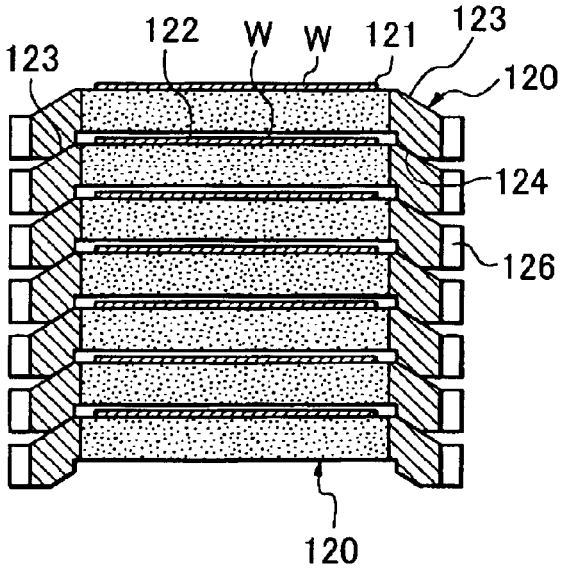
FIG. 18 illustrates, in section, how a plurality of flat-object holders can be laid on each other.

The support 127 is an annular body whose outer front side diverges downward to form a bearing shoulder 123, and the oblique front side ends with the vertical outer circumference 125. The support 127 has an inner rear side diverging from the circumference of the circular opening to the lower edge of the vertical outer circumference 125 to form a landing seat 124. The flat-object holder 120 has a recess 122 on its bottom to accommodate the flat object of the lower flat-object holder in a non-contact fashion when two or more flat-object holders are laid on each other, as seen from FIG. 18. The bearing shoulder 123 of the lower flat-object holder abuts the landing seat 124 of the upper flat-object holder for bearing the upper flat-object holder.

Thus, there is no fear of damaging semiconductor wafers when stacking. Therefore, stacks of semiconductor wafers can be transferred from place to place without using such containers 21, 50 as shown in FIG. 6. Accordingly, the expense involved for containing such fragile objects in appropriate containers and for allotting extra spaces for such containers can be saved.

A flat-object holder capable of heating a flat object is described below. It is necessary that semiconductor wafers be heated when certain kinds of protection tape 65, die-attachment film 100 and dicing tape 104 are applied to the semiconductor wafers. Hitherto, machines or apparatuses used have been equipped with a heating means, which can heat the semiconductor wafer laid on a jig which permits heat conduction from the heating means to the semiconductor wafer.

Heating a very thin semiconductor wafer is apt to induce cracking of the wafer due to uneven thermal expansion. This unfavorable tendency will be noticeable when use is made of a die-attachment film requiring heating in a temperature ranging from 100° to 150°. The cracking cannot be prevented unless the heating of the semiconductor wafer is locally controlled.

In an attempt to reduce such a defect, a length of electric heating wire is arranged and embedded in the flat-object holder 60 or 120 to form a geometrical heating pattern according to which the heating can be gradually expanded while suppressing the cracking of the wafer and while continuing to apply the die-attachment film to the wafer.

Figure 19:
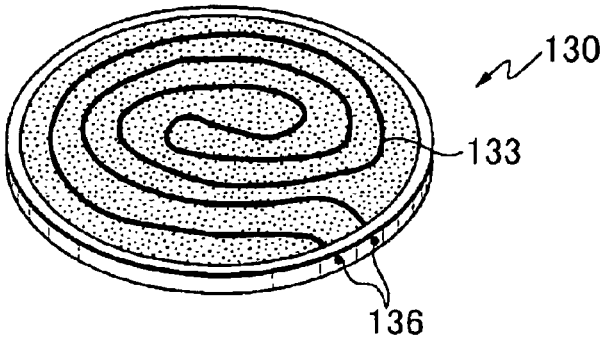
FIG. 19 is a perspective view of a first example of a flat-object holder having a temperature-controlling means embedded therein.
Figure 20:
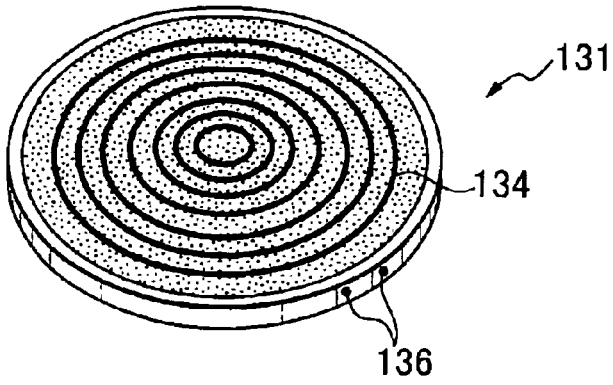
FIG. 20 is a perspective view of a second example of a flat-object holder having a temperature-controlling means embedded therein.
Figure 21:
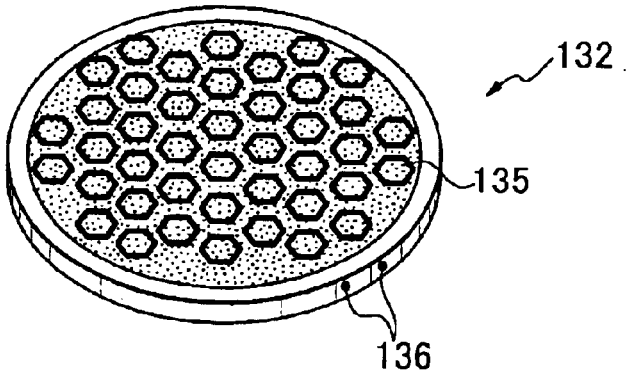
FIG. 21 is a perspective view of a third example of a flat-object holder having a temperature-controlling means embedded therein.

Referring to FIGS. 19, 20 and 21, the flat-object holders 130, 131 and 132 have different geometrical patterns of electric heating wire embedded in their flat object supporting areas. Each fiat-object holder has one or more pairs of contact terminals 136 to locally supply the electric heating wire with electricity. Preferably, the machine or apparatus is constructed so that it may have counter contact terminals to mate with the contact terminals of the flat-object holder when it is set on the machine or apparatus.

Figure 22:
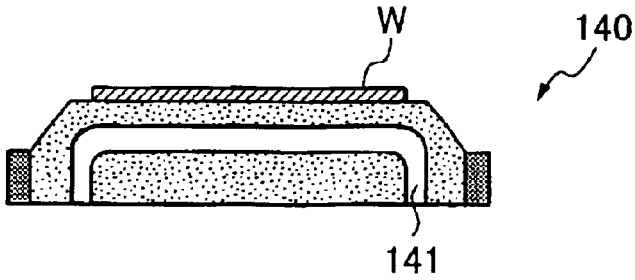
FIG. 22 is a sectional view of a fourth example of a flat-object holder having a temperature-controlling means embedded therein.

Referring to FIG. 22, a fat-object holder 140 has a conduit 141 formed in its flat object supporting area, thereby permitting a thermal medium to circulate in the flat object supporting area. Such thermal medium includes liquid natrium at an elevated temperature and liquid nitrogen at a low temperature. When grinding a semiconductor wafer W, the cooling is necessary to suppress the rise of temperature caused by friction, whereas when applying a die-attachment film to the semiconductor wafer W, the heating is necessary to soften the die-attachment film.

When removing the flat-object holder 140, it is heated to thermal) expand, thereby facilitating removal of the flat-object holder 140 from the grinding machine Alternatively, a Peltier element may be embedded in the flat object supporting area, so that the temperature of the flat object supporting area may be controlled to cool or heat the overlying semiconductor wafer by controlling the voltage applied to the Peltier element.

Figure 23:
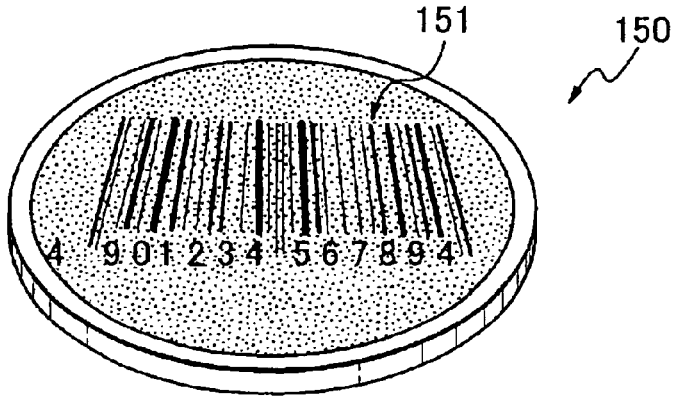
FIG. 23 is a perspective view of a first example of a flat-object holder having an identification means provided therewith.

Referring to FIG. 23, the flat-object holder 150 has an identification means in the form of bar codes 151 on its rear side, so that manufacturing management may be facilitated when transferring semiconductor wafers from station to station for different treatments, which must be performed at the right position and situation established in consideration of pieces of information representing the conditions of semi-products and machining apparatuses.

Figure 24:
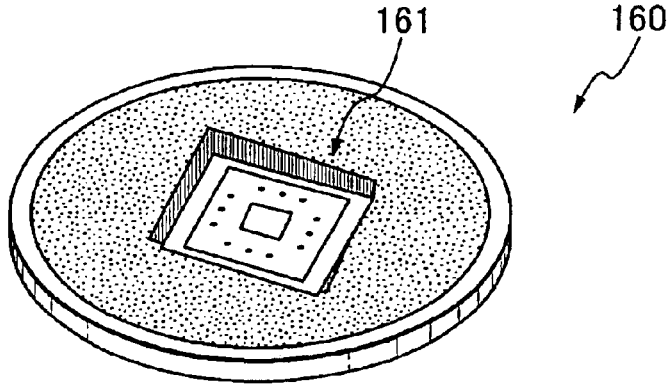
FIG. 24 is a perspective view of a second example of a flat-object holder having an identification means provided therewith.
Figure 25:
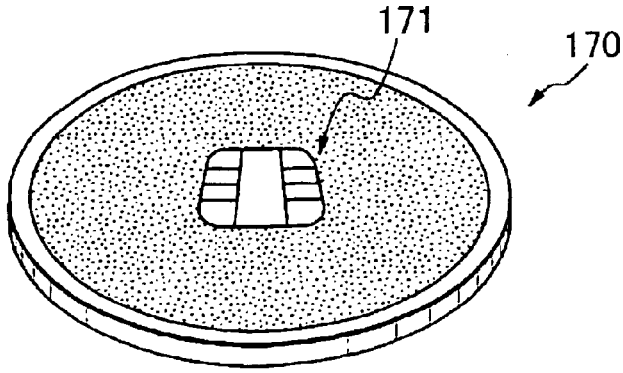
FIG. 25 is a perspective view of a third example of a flat-object holder having an identification means provided therewith.

Another example of an identification means is IC chips 161 and 171 on the flat-object holders 160 and 170 (see FIGS. 24 and 25). Writing-in and reading-out of pieces of information are permitted in IC chips, thus providing the flat-object holder with traceability.

When grinding a semiconductor wafer to a desired thickness, the removal amount of semiconductor material is determined in terms of how high the ground surface of the semiconductor wafer is from the reference level at which the suction surface of the chuck table is, which reference level is measured by a height gauge. If a semiconductor wafer is laid on a flat-object holder, and the flat-object holder is put on a selected chuck table, the removal amount of semiconductor material depends on the height of the flat-object holder, which varies with each flat-object holder. Therefore, the removal amount of semiconductor material cannot be determined accurately without measuring the height of an individual flat-object holder.

Each and every flat-object holder is measured in thickness, and the measured thickness is given to the flat-object holder, for instance, in the form of bar codes. In grinding the semiconductor wafer, a piece of information representing the thickness of the flat-object holder is retrieved from the bar code to determine the required removal amount of semiconductor material for each wafer-and-holder assembly. Thus, when the wafer-and-holder is changed to grind a new semiconductor wafer, the reference level need not be readjusted in height. Accordingly, the grinding work can be effected with an increased efficiency and accuracy The quantity of resistance to the peeling-off of the protection tape from the semiconductor wafer and other pieces of information in different processes can be recorded and used in combination with wafer identifications, lot information and other data in a data server, thereby permitting required data to be available in fulfilling all necessary controls according to the processing schedule.

Figure 26:
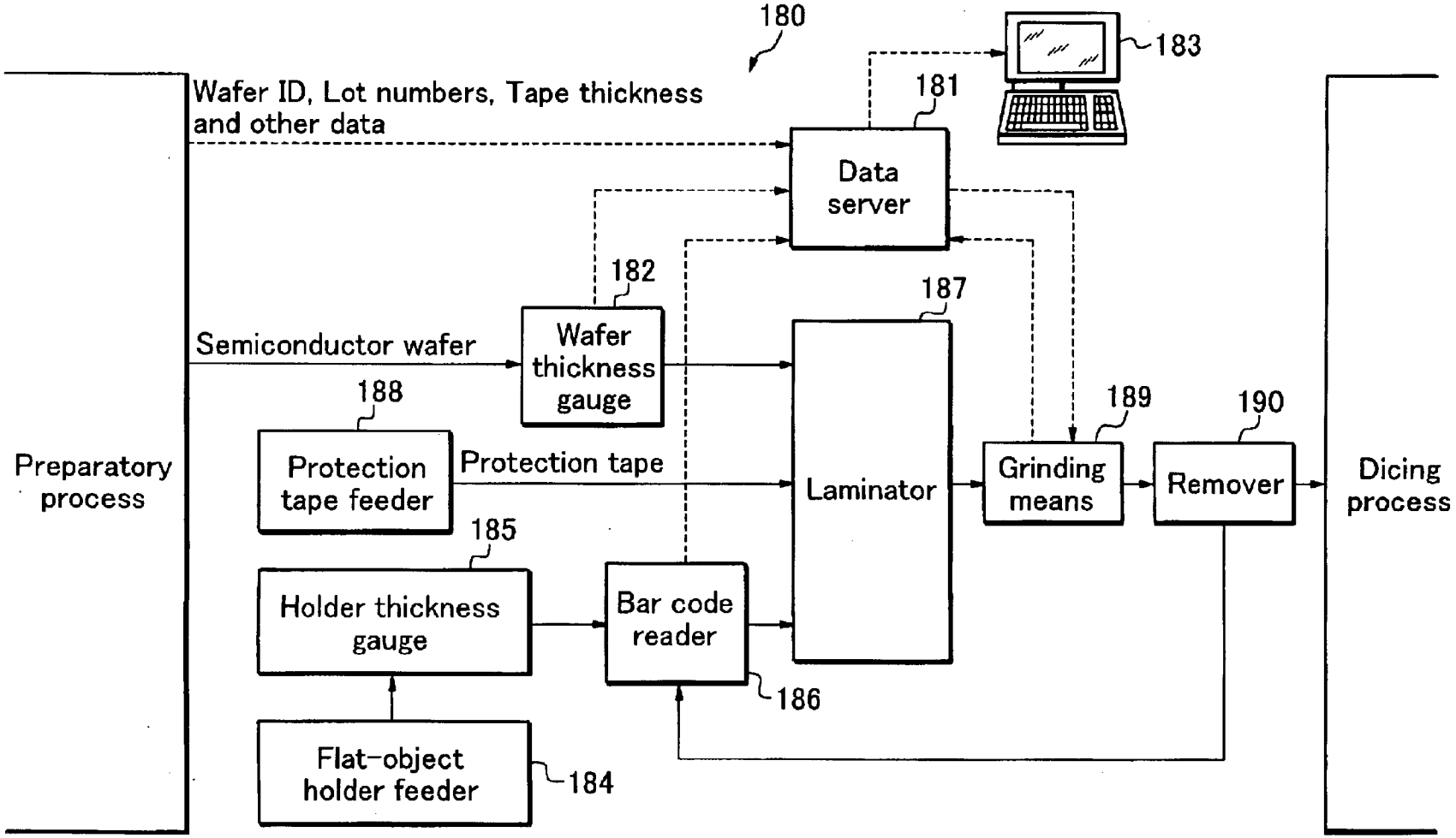
FIG. 26 shows a management system using a flat-object holder according to the present invention.
Figure 27:
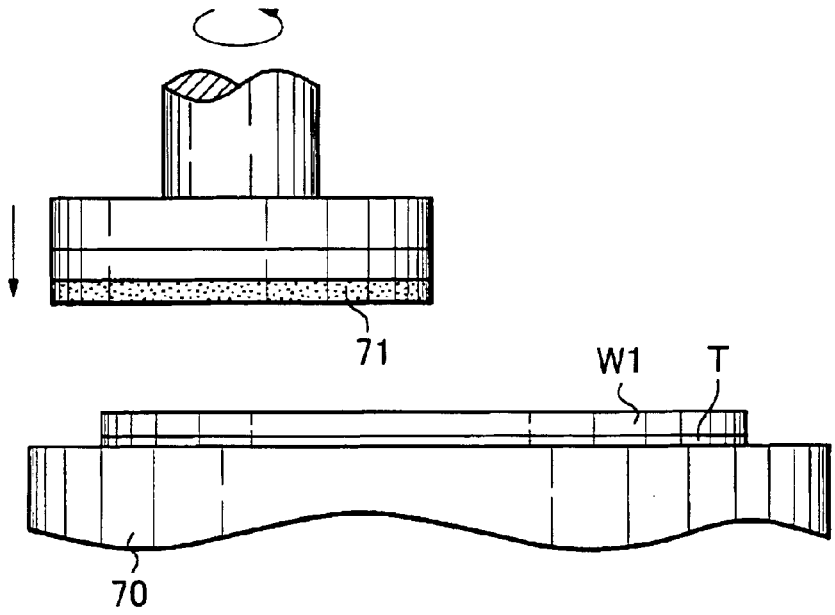
Fig. 27 PRIOR ART
FIG. 27 illustrates a conventional manner in which a semiconductor wafer is supported by a selected chuck table in a grinding machine.
Figure 28:
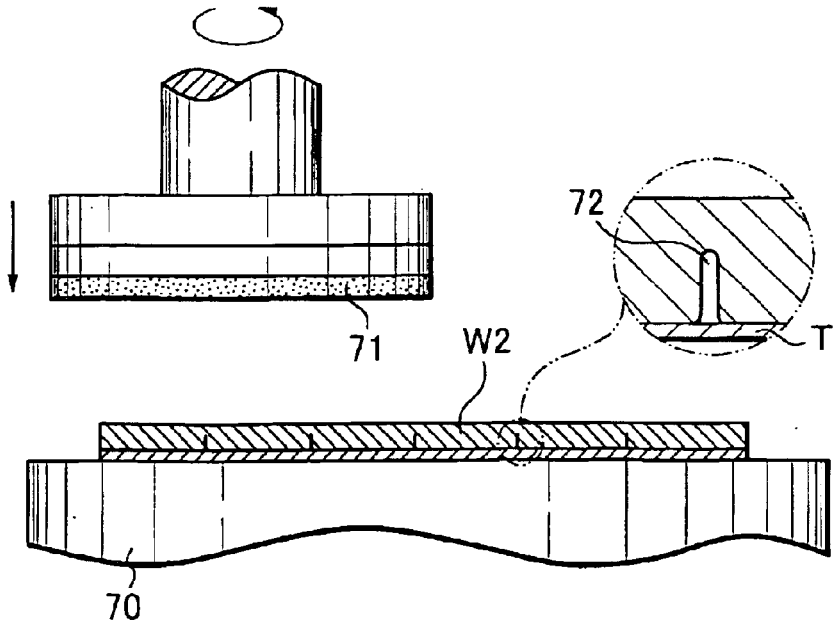
Fig. 28 PRIOR ART
FIG. 28 illustrates, in section, a conventional pre-dicing mode according to which a semiconductor wafer is diced while being supported by a selected chuck table in a grinding machine.
Figure 29:
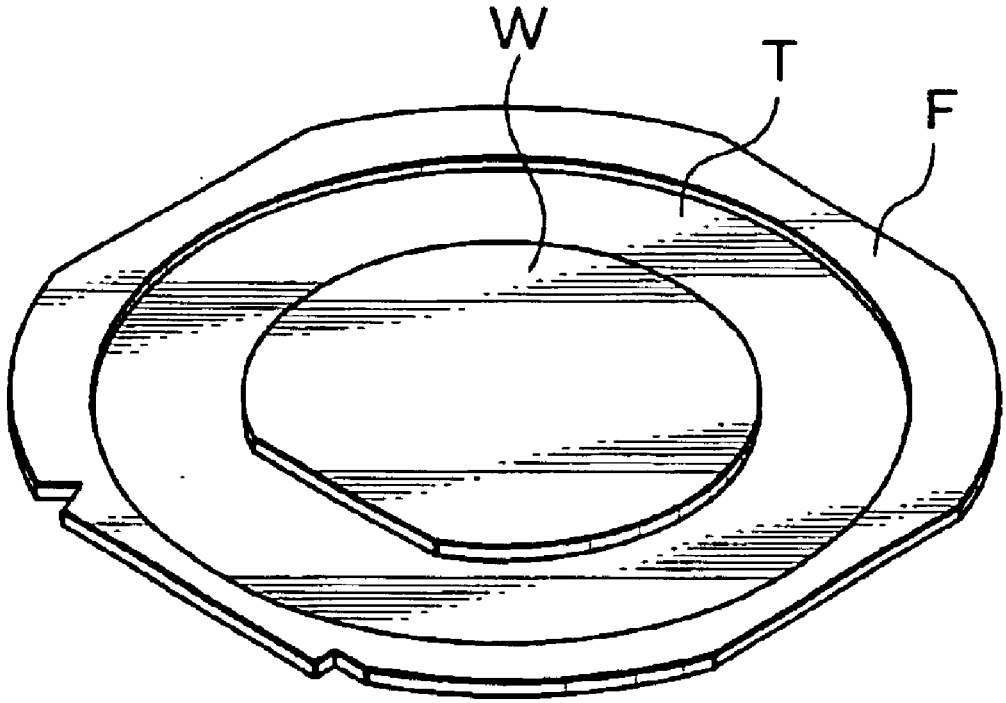
Fig. 29 PRIOR ART
FIG. 29 is a perspective view of a conventional semiconductor wafer-and-frame assembly.

FIG. 26 shows a process-management system 180. As shown in the drawing, wafer identifications, lot numbers, thickness of protection tapes and other data are transferred to the data server 181. At the same time, semiconductor wafers are transferred to the wafer-thickness gauge 182 to determine the thickness of each and every semiconductor wafer, which is stored in the data server 181 in terms of each wafer identification and lot number so that the operator at each terminal 183 may identify each semiconductor wafer in terms of its physical characteristics.

Flat-object holders are fed from the holder feeder 184 to the holder thickness gauge 185 to measure the thickness of each flat-object holder, and a bar code representing the measured thickness of the flat-object holder is applied to the rear side of the flat-object holder. The bar code reader 186 reads the bar code to transfer the retrieved data to the data server 181.

The protection tape feeder 188 feeds protection tapes to the laminator 187 one after another, and a protection tape is applied to the front side of each semiconductor wafer. Then the wafer-and-holder assembly is transferred to the grinding means 189.

After grinding the rear side of the semiconductor wafer using the grinding means 189, the flat-object holder 190 is removed from the wafer-and-frame assembly by the remover means 190. The wafer-free holder can be identified in terms of its bar code to be used again for grinding another semiconductor wafer without measuring the thickness of the flat-object holder.

As may be understood from the above, a lot of flat-object holders can be handled in terms of their identification data and other particulars available from the data server 181 to grind all semiconductor wafers to a desired thickness by removing the exact removal amount of semiconductor material.

As may be apparent from the above, a flat-object holder according to the present invention can fixedly hold a flat object-and-frame assembly. Therefore, no matter how thin the flat object may be, it can be held in such a stable condition that the very thin object may be transferred, put in a container, and peeled off without difficulty.

Advantageously, the wafer-and-holder assembly can be put on a selected chuck table without the necessity of modifying the chuck table.

What is claimed is:

1. A method of holding a flat object, comprising:

applying a periphery of an adhesive protection tape to a frame;

adhering the flat object to the adhesive protection tape;

fixing the frame on a holder having a flat object supporting area so that the flat object is supported on the flat object supporting area and the adhesive protection tape is located between the flat object and the flat object supporting area;

placing the holder supporting the flat object on a chuck table;

grinding the flat object supported by the holder on the chuck table using a grinding device;

removing the holder supporting the flat object from the chuck table after completion of said grinding so as to thereby remove the flat object from the chuck table; and transporting the holder supporting the flat object away from the chuck table after said removing so as to thereby transport the flat object away from the chuck table.

2. The method of claim 1, wherein the frame has a central opening therein, said applying comprising applying only the periphery of the adhesive protection tape to the frame so that a portion of the adhesive protection tape covers and closes the central opening of the frame.

3. The method of claim 2, wherein said adhering comprises adhering the flat object to the portion of the adhesive protection tape covering and closing the central opening of the frame.

4. The method of claim 1, wherein said fixing the frame on the holder comprises fixing the frame on the holder so that the periphery of the adhesive protection tape applied to the frame is held between the frame and a periphery of the holder.

5. The method of claim 1, wherein said placing the holder on the chuck table includes applying a negative pressure to the holder via the chuck table so as to hold the holder to the chuck table via the negative pressure.

6. The method of claim 5, wherein the flat object supporting area of the holder is made of a porous material, said applying of the negative pressure to the holder comprises applying the negative pressure to the flat object supporting area of the holder to as to hold the flat object to the holder via the negative pressure and the adhesive protection tape.

7. The method of claim 1, wherein the flat object supporting area of the holder is made of a porous material.

8. The method of claim 1, further comprising:

applying a die-attachment film to the flat object after said grinding of the flat object;

applying a dicing tape to the die-attachment film; and applying a dicing frame onto a periphery of the dicing tape.

9. The method of claim 8, further comprising:

after said applying of the dicing frame, removing the dicing frame, the holder, and then adhesive protection tape all together from the flat object.

10. The method of claim 1, wherein the flat object is one of a semiconductor wafer, a rearranged and wired semiconductor substrate, and a rearranged, wired, and resin-sealed semiconductor substrate.

* * * * *